United States Patent [19]

Czelusniak, Jr.

[11] 4,034,781

[45] July 12, 1977

[54] PILE FABRIC FORMING APPARATUS HAVING COOPERATING PAIRS OF PILE WIRES

[75] Inventor: Paul Anthony Czelusniak, Jr., Eden, N.C.

[73] Assignee: Fieldcrest Mills, Inc., Eden, N.C.

[21] Appl. No.: 684,877

[22] Filed: May 10, 1976

[51] Int. Cl.[2] ..... D03D 39/20

[52] U.S. Cl. ..... 139/46

[58] Field of Search ..... 139/37, 39, 46, 47, 139/44

[56] References Cited

U.S. PATENT DOCUMENTS

| | | | |
|---|---|---|---|
| 1,054,952 | 3/1913 | Watti | 139/47 |
| 1,689,384 | 10/1928 | Grosvenor et al. | 139/47 |
| 2,870,795 | 1/1959 | Berry | 139/44 |

FOREIGN PATENT DOCUMENTS

| | | | |
|---|---|---|---|
| 489,441 | 1/1930 | Germany | 139/44 |

*Primary Examiner*—Henry S. Jaudon

*Attorney, Agent, or Firm*—Bell, Seltzer, Park & Gibson

[57] ABSTRACT

Pile wires extending longitudinally of the fabric being formed and are arranged in side-by-side cooperating pairs of first and second pile wires, with only the first pile wires having cutting blades so arranged as to cut loops previously formed over both pile wires of each cooperating pair while they occupy a first position. Means imparts relative longitudinal movement to each cooperating pair of pile wires, and cooperating means on the pile wires is responsive to such relative movement of the pile wires to a second position for diverting the first pile wire laterally away from the second pile wire of the respective pair so that loops of pile yarn are formed over only the second pile wire and thus form uncut pile loops in the fabric.

10 Claims, 7 Drawing Figures

PILE FABRIC FORMING APPARATUS HAVING COOPERATING PAIRS OF PILE WIRES

This invention relates to apparatus for forming pile fabrics, such as weaving machines, tufting machines, knitting machines and the like provided with pile wires extending longitudinally of the fabric being formed and over which pile yarns are lopped in the production of pile fabrics having cut and/or uncut pile tufts.

Heretofore, apparatuses utilizing longitudinally extending pile wires for forming pile fabrics having cut and uncut pile tufts have been provided with various arrangements of cutting blades facilitating cutting pile yarns looped over and across pile wires concurrently with forming the fabric. Very pleasing cut and uncut pile effects have been obtained heretofore utilizing apparatuses of this type as disclosed, for example, in Moberg's U.S. Pat. No. 2,860,664 and Clark's U.S. Pat. No. 2,860,666, both dated Nov. 18, 1958. Such prior art apparatuses also have served well in the production of pile fabrics having low uncut pile tufts or loops in the same longitudinal rows as those in which substantially higher cut pile tufts are present. However, in instances where it is desirable to have the cut pile tufts about the same height as or only slightly higher than that of the uncut pile tufts in the same longitudinal rows, it has been necessary heretofore to pass the pile fabric through a shearing machine several times so as to shear away the substantial excessive amount of pile yarn from the higher pile tufts, since heretofore the higher pile tufts had to be formed over high loop-forming stages on the pile wires of the pile fabric forming apparatus, and the high loop-forming stages had to be of sufficient height to accommodate therebeneath loops of pile yarn previously formed over the respective lower loop-forming stages of the respective pile wires.

It is axiomatic that the greater the number of times that it is necessary to pass the pile fabric through the shearing machine, the greater is the cost of manufacturing the fabric, notwithstanding the relatively large amount of the pile yarn fibers turned into waste by the shearing operations.

It is therefore the primary object of this invention to provide an improved apparatus for forming pile fabrics having cut and uncut pile tufts in given rows extending in the lengthwise or machine direction of the fabric, and wherein such pile tufts are so formed as to generally eliminate the need for shearing the fabric more than once in order for the cut pile tufts to be of substantially uniform height and of substantially the same or only slightly greater height than the uncut pile tufts or loops, thereby substantially reducing the cost of the shearing procedure and the consequent cost of the pile fabric.

According to the disclosed and preferred embodiment of the invention, the apparatus has pile wires extending longitudinally of the fabric being formed, with means for positioning pile yarns laterally over and across the pile wires and dipping the pile yarns into and out of the fabric between the pile wires for forming pile loops thereover, and the apparatus is characterized in that a plurality of the pile wires are arranged in side-by-side cooperating pairs of first and second pile wires, with only the first pile wires having cutting blades on frontal portions thereof. Each cooperating pair of pile wires is so arranged that, while they occupy a first position, they are in close proximity where the pile yarns are positioned thereover for forming pile loops extending over both pile wires of the respective pair, with such loops subsequently being cut by the cutting blade on the frontal portion of the respective first pile wire. Relative longitudinal movement is imparted to each cooperating pair of pile wires, and cooperating means is provided on the pile wires of each cooperating pair and is responsive to relative longitudinal movement of the pile wires to a second position for diverting the first pile wire laterally away from the second pile wire of the respective pair so that loops of pile yarn are formed over only the second pile wire and thus form uncut pile loops in the fabric.

As preferred, but not necessarily, the frontal portions of both pile wires of a cooperating pair are of approximately the same height so that loops formed over both pile wires and before being cut are of about the same or only slightly greater height than those loops formed over only the respective second pile wire.

Some of the objects and advantages of the invention having been stated, others will appear as the description proceeds when taken in connection with the accompanying drawings, in which.

Referring more specifically to the drawings, the invention is embodied in a weaving machine or loom of the type as generally disclosed in U.S. Pat. Nos. 2,437,378 (Clark); 2,808,072 (Stovall); 2,860,664 (Moberg) and 3,741,255 (Ostler), for example. As the description proceeds, however, it will be apparent that one skilled in the art may readily apply the principles of the invention to knitting machines, tufting machines and the like without departing from the invention. Exemplary knitting and tufting machines to which the principles of the invention may be readily applied are disclosed in Clark's U.S. Pat. No. 3,140,592 and MacIsaac, Jr. et al's U.S. Pat. No. 3,677,206, respectively.

Figures 1, 2, 3:
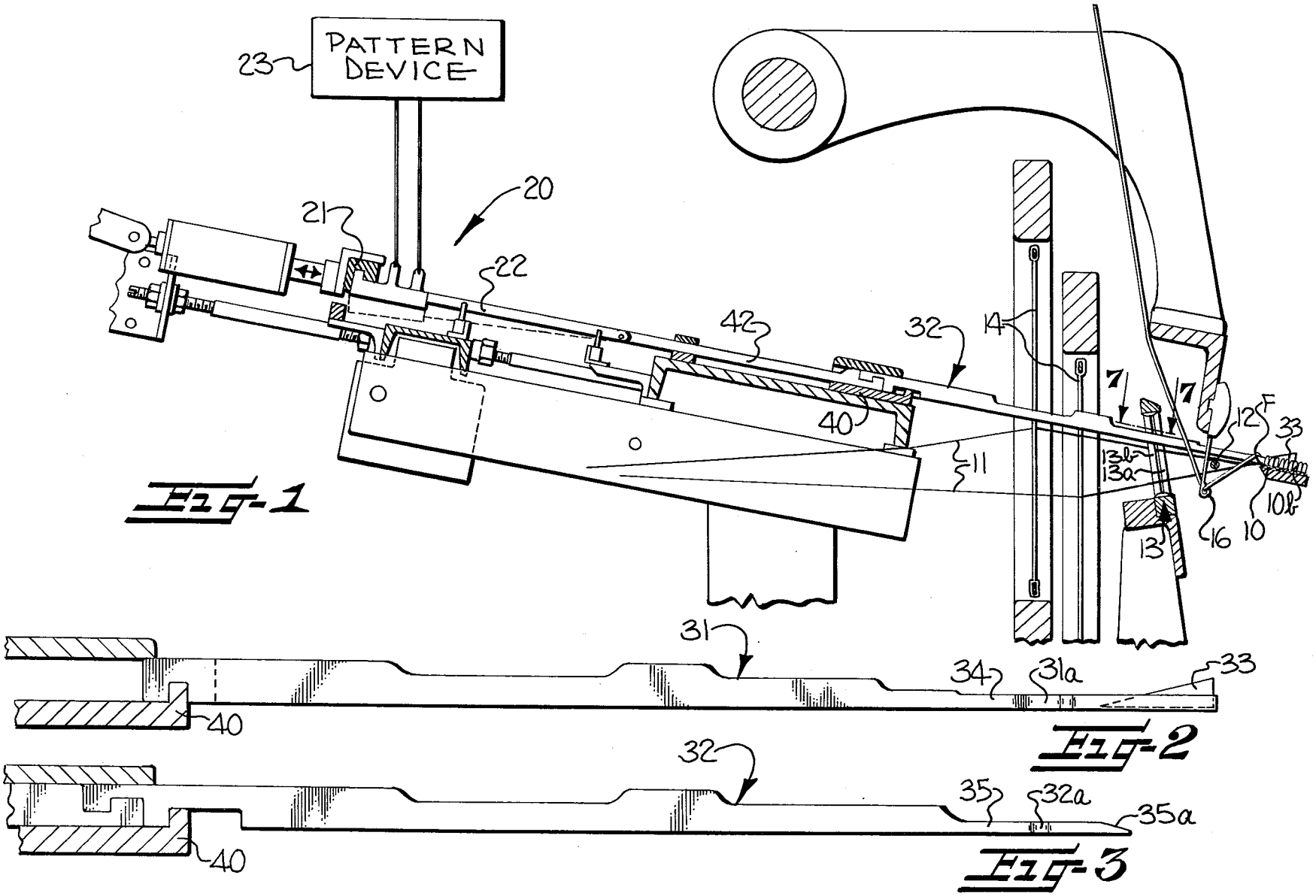
FIG. 1 is a sectional elevation view through a weaving machine exemplifying environmental apparatus with which the preferred embodiment of the invention is associated.
FIGS. 2 and 3 are enlarged side elevation views of the respective pile wires of a cooperating pair according to the invention.

Referring to FIG. 1, the weaving machine or apparatus there shown includes means for weaving a base fabric 10 from warp yarns 11 and weft yarns, not shown, wherein the weft yarns are inserted in the warp shed by a suitable weft inserting means 12 and are beaten up, by an oscillatable reed 13, against the fell F of the fabric being formed. Reed 13 may be of conventional or other construction, as desired, and it is shown as having spaced alternate reed dents **13*a* so that the reed dents may be positioned guite close to one another as may be desirable for forming high-density pile fabrics. Suitable heddles or other shed forming means 14** are provided for effecting operation of the warp yarns to form warp sheds thereof as is usual.

The apparatus includes a transverse row of closely spaced elongate pile wires, to be later described. Frontal portions of the pile wires overlie the fabric adjacent the fell F, and suitable means are provided, in the form of pile yarn guides 16, for looping continuous pile yarns 17 over and across respective pile wires and for also dipping the pile yarns into the fabric below the level of the weft inserting means 12 and between the pile wires. Means 20 are provided for imparting longitudinal movement to at least certain of the pile wires. Conveniently, the longitudinal movement imparting means 20 is shown as being of the type disclosed in the aforementioned U.S. Pat. No. 3,741,255 and includes a transverse channel bar 21 which reciprocates forwardly and rearwardly in timed relation to the operation of the apparatus so as to receivingly engage the upwardly projecting or hooked rear end portions of control levers 22 as they are lifted by a suitable pattern device 23.

Also, when levers 22 are released by pattern device 23 and upon bar 21 reaching its illustrated rearmost position, the hooked rear ends of the respective levers 22 are free to move downwardly out of engagement with channel bar 21 so that they remain in the rearward or withdrawn position during the subsequent forward and rearward strokes of channel bar 21. The front end portions of control levers 22 are operatively connected to those pile wires which are to be shifted forwardly and rearwardly according to the desired pile pattern.

To the extent that the descriptions of the arrangements to be found in the aforementioned patents are necessary for a clear understanding of the present invention, those descriptions are hereby incorporated by reference into this specification.

According to the invention, a plurality of the pile wires are arranged in cooperating of first and second pile wires 31 and 32, respectively, with only the first pile wire 31 of each cooperating pair having a cutting blade 33 on a frontal portion 34 thereof. The second pile wires also have respective frontal portions 35 which extend alongside the frontal portions of the respective first pile wires but preferably are foreshortened so that their rounded or tapered forward ends terminate rearwardly of the forward ends of the first pile wires. Each cooperating pair of pile wires 31, 32 is so arranged that, while they occupy a first position (see FIG. 4) they are in close proximity where the pile yarns are positioned thereover (loop-forming zone) for forming pile loops extending over both wires 31, 32, with such loops subsequently being cut by the cutting blade 33 on the frontal portion of the respective first pile wire, thus forming cut pile tufts 10*a* in the fabric. On the other hand, upon predetermined relative longitudinal movement being imparted to each cooperating pair of pile wires by the means 20 (FIG. 1), cooperating means on the pile wires of each cooperating pair is responsive to such relative movement of the pile wires to a second position (see FIG. 5) for diverting the first pile wire laterally away from the second pile wire of the cooperating pair so that loops of pile yarn are formed over only the second pile wire and thus form uncut pile tufts or loops 10*b* in the fabric.

A preferred structural arrangement of the pile wires 31, 32 of a cooperating pair for forming cut and uncut pile tufts according to the broad concept set forth above and in the desired sequences will now be described.

At the outset, it is preferred that the pile yarn guides 16 move in essentially the same respective paths during each operation thereof for shogging and positioning pile yarns laterally over and across respective pile wires first in one direction and then in the other direction, as is usual. Therefore, at least a lengthwise portion of each first pile wire 31 adjacent its cutting blade 33 is formed of a more flexible material than the adjacent portion of the cooperating second pile wire 32. In an actual apparatus, it has been determined that each first pile wire 31 may take the form of a relatively thin flexible strip material, such as spring steel, and each second pile wire 32 may take the form of a thicker, substantially rigid or more inflexible strip material.

The terminal forward end of the frontal portion 34 of each first pile wire 31 may be of increased thickness adjacent and forwardly of the terminal forward end of the frontal portion 35 of the cooperating second pile wire 32 for supportingly receiving the cutting blade 33 therein. In such instance, it is preferred that the forward end of the second pile wire 32 does not extend beyond the lateral plane of the rear end of the portion of increased thickness any further than may be necessary to accommodate the positioning of the loops of pile yarn (loop-forming zone) over and across the pile wires. It is also preferred that at least that portion of the forward end of the second pile wire extending forwardly of the lateral plane of the rear end of the portion of increased thickness is tapered or beveled downwardly and forwardly, substantially as shown at 35*a* in FIGS. 3, 4 and 5, so that loops formed over the relatively thinner frontal portion of the first pile wire and over the frontal portion 35 of the second pile wire 32 will not be subsequently unduly stretched and enlarged by the portion of increased thickness on the first pile wire 31 as the loops advance therealong and are being cut by the respective cutting blade 33.

The first pile wires 31 may be mounted so as to be substantially immovable in the lengthwise direction, as by the rear end portions thereof being keyed or otherwise attached to a transverse frame member or slotted supporting means 40 (FIGS. 1 and 2). On the other hand, each second pile wire 32 is connected, via an extension arm 42, to a respective one of the control levers 22 (FIGS. 1 and 3). Thus, it can be appreciated that the second pile wires 32 are moved longitudinally (forwardly and rearwardly) in the slotted supporting means 40 relative to the first pile wires 31 according to a predetermined pattern. As preferred, there is one pile yarn guide 16 for each cooperating pair of pile wires 31, 32, and both pile wires 31, 32 of each cooperating pair are positioned to extend through a single reed space (FIG. 7) so that the "gauge" of adjacent warpwise or lengthwise rows of pile tufts will be essentially the same lengthwise of a particular fabric when both cut and uncut pile tufts are present in such rows.

Figure 6:
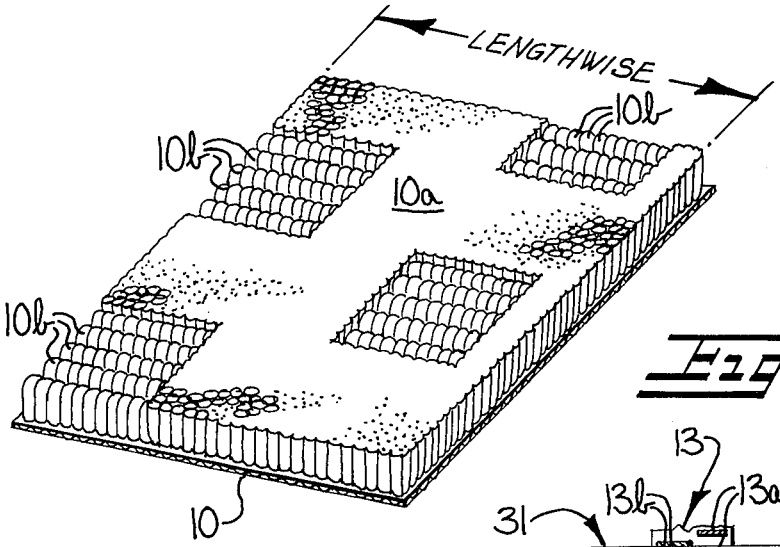
FIG. 6 is a fragmentary perspective view of a pile fabric illustrating one of many different patterns of cut and uncut pile tufts which may be formed by the apparatus of this invention.

Stated otherwise, any given lengthwise row of pile loops may be cut at selected intervals to form the desired pattern of cut and uncut pile tufts, such as that shown by way of example in FIG. 6. Also, the cut pile tufts 10*a* may be formed about the same height as or slightly higher than the loop pile tufts 10*b* by utilizing cooperating pairs of pile wires 31, 32 whose frontal portions 34, 35 are both of about the same height. It is to be understood, however, that the frontal portion of either pile wire 31, 32 of a cooperating pair may be of greater height than the frontal portion of the other pile wire of the cooperating pair, if so desired.

Figure 4:
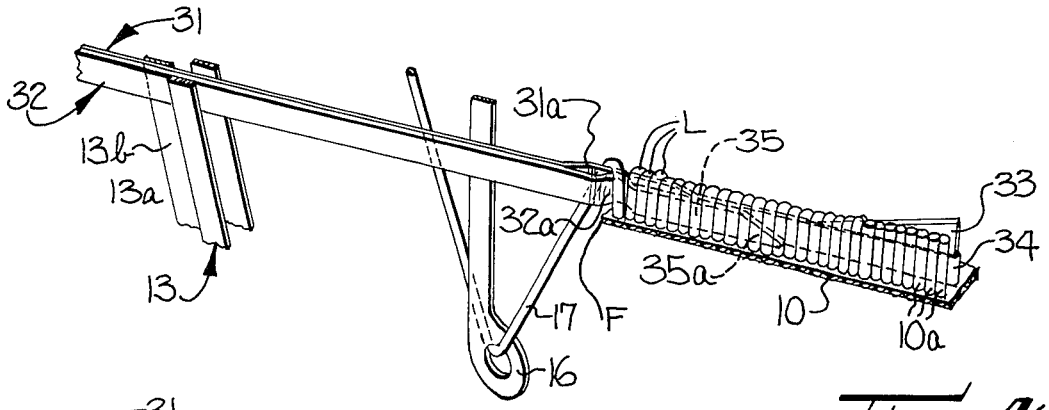
FIG. 4 is a fragmentary perspective view of one pair of the cooperating pile wires occupying a first position for forming cut pile tufts.

It will be observed in FIG. 4 that, when the pair of cooperating pile wires 31, 32 occupy the first position there shown, a laterally offset portion 31*a* extending along the first pile wire 31 is in substantially lateral alignment with a laterally offset portion 32*a* on the cooperating second pile wire 32, with the laterally offset portion 32*a* facing in a lateral direction common with that of the offset portion 31*a* of the cooperating first pile wire 31. It is preferred that the laterally offset portions 31*a*, 32*a* are located in the frontal portions 34, 35 of the respective pile wires 31, 32 where the upper edges of the pile wires define loop forming stages, with the proximal surfaces of the frontal portions being in close proximity when the offset portions 31*a*, 32*a* are in substantially lateral alignment. Thus, the respective pile yarn guide 16 will form loops L (FIG. 4) extending over and across both pile wires 31, 32 of the cooperating pair, with such loops subsequently being cut by the cutting blade 33 on the frontal portion 34 of the cooperating first pile wire 31 as the fabric 10 advances during the formation thereof.

It is to be noted that the slotted supporting means 40 (FIGS. 1, 2 and 3) is arranged so as to position the rear end portions of the pile wires 31, 32 of each cooperating pair relatively close to each other and preferably in contacting side-by-side relation. Any suitable means may be provided for positioning the frontal portions of the pile wires of each cooperating pair in close proximal or contacting side-by-side relation when the laterally offset portions 31*a*, 32*a* thereof are in lateral alignment with each other as in FIG. 4. This may be at least partially achieved by the slotted supporting means 40 (FIGS. 1, 2 and 3) engagingly and supportingly receiving the rear end portions of the pile wires therein.

Figure 7:
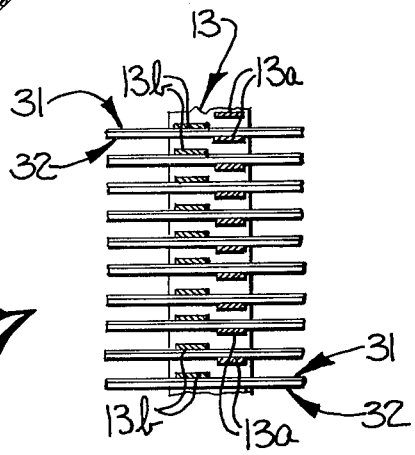
FIG. 7 is an enlarged fragmentary sectional plan view through a loom reed showing some of the pile wires extending therethrough and being taken substantially along line 7—7 in FIG. 1.

To aid further in retaining the close proximal relationship or contacting relationship of the pile wires of each pair so that each first pile wire 31 will yieldably oppose any force tending to move the same laterally outwardly away from the respective second pile wire 32, each cooperating pair of pile wires extends through a respective common reed space and the distal surfaces of each cooperating pair of pile wires may be slidably engaged by the proximal surfaces of the immediately adjacent pair of reed dents 13*a*, 13*b* (FIG. 7). It is desirable, but not essential, that the pairs of cooperating pile wires 31, 32 extend through the alternate reed spaces defined by reed dents 13*a*, 13*b* and that intervening reed spaces be devoid of any pile wires therethrough, with ground warp yarns 11 extending through the alternate and the intervening reed spaces.

Figure 5:
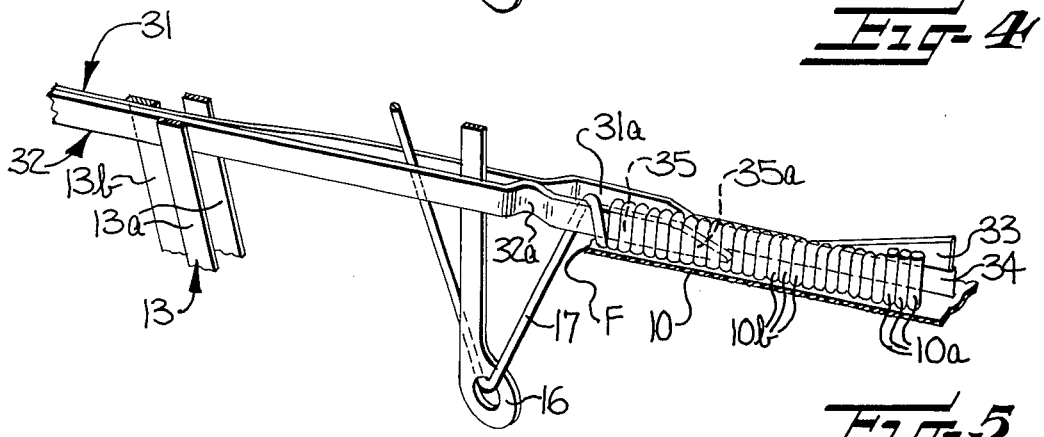
FIG. 5 is a view similar to FIG. 4, but wherein the pile wires occupy a second position for forming uncut or loop pile tufts.

Now, as relative longitudinal movement is imparted to a cooperating pair of pile wires 31, 32 by virtue of the means 20 of FIG. 1 moving the second pile wire 32 rearwardly relative to the first pile wire 31, the laterally offset portion 32*a* on the second wire moves rearwardly relative to the offset portion 31*a* on the first wire while moving into sliding engagement with the proximal surface of the first pile wire so that the respective offset portions 31*a*, 32*a* are longitudinally offset. Since the offset portion 32*a* of the second pile wire 32 then bears against the more flexible first pile wire 31, the offset portion 32*a* flexes the frontal portion 31*a* laterally away therefrom to the second position substantially as shown in FIG. 5. In so doing, the portion of the first pile wire 31 adjacent the path of movement of the respective pile yarn guide 16 is moved laterally outwardly of the downward path of the pile yarn guide 16 as it is looping the pile yarn 16 from adjacent the outer side of the second pile wire over the same and toward the cooperating first pile wire. Thus, the pile yarn guide 16 moves downwardly between the proximal surfaces of the cooperating pair of pile wires 31, 32 and carries the pile yarn 17 with it. Loops of the pile yarn 17 thus are formed over only the second pile wire 32 to form uncut pile loops 10*b* in the fabric.

From the foregoing description, it can be appreciated that the laterally offset portion 32*a*, and the proximal side of a lengthwise portion of the first pile wire 31 being engaged by the offset portion 32*a*, collectively serve as the aforementioned cooperating means on the pile wires 31, 32 of each cooperating pair for camming or diverting the first pile wire 31 laterally away from the second pile wire in response to relative longitudinal movement of the pile wires from the first position (FIG. 4) to the second position (FIG. 5).

It is to be noted that, in order to clearly illustrate the laterally offset portions 31*a*, 32*a* in FIGS. 4 and 5, the fell F of the fabric being formed is there shown as being located forwardly of the rear portions of the laterally offset portions 31*a*, 32*a* of the pile wires 31, 32. However, since it is preferred that reed dents 13*a*, 13*b* slidably engage the distal surfaces of each cooperating pair of pile wires in this instance, it is apparent that the beat-up point of the reed 13 (and consequently the fell F) actually is located at the rear ends of the laterally offset portions 31*a* so that the reed will not strike and damage the offset portions of the pile wires during beat-up strokes of the reed.

It is thus seen that the invention provides a simple and efficient arrangement of cooperating pairs of pile wires for selectively forming cut and uncut tufts in the fabric and wherein, in the case of a weaving machine, there is no need for forming the cut pile tufts over pile wires which extend through different reed spaces from those reed spaces through which extend the pile wires over which the uncut pile tufts are formed as has been necessary heretofore when the cut pile tufts were to be formed of about the same height as or slightly higher than the uncut pile loops while the fabric is being formed.

In the drawings and specification there has been set forth a preferred embodiment of the invention, and although specific terms are employed, they are used in a descriptive and generic sense only and not for purposes of limitation.

That which is claimed is:

1. In an apparatus for forming pile fabrics having cut and uncut pile tufts and wherein pile wires extend longitudinally of the fabric being formed and means are provided for positioning pile yarns laterally over and across the pile wires for forming pile loops thereon and for dipping the pile yarns into the fabric between the pile wires, the improvement wherein a plurality of the pile wires, are arranged in side-by-side cooperating pairs of first and second pile wires, only said first pile wires having cutting blades on frontal portions thereof, each cooperating pair of pile wires being so arranged that, while they occupy a first position they are in close proximity where the pile yarns are positioned thereover for forming pile loops extending over both wires, with such loops subsequently being cut by the cutting blade on the frontal portion of the respective first pile wire, means for imparting relative longitudinal movement to each cooperating pair of pile wires, and cooperating means on the pile wires of each cooperating pair and responsive to relative longitudinal movement of the pile wires to a second position for diverting the first pile wire laterally away from the second pile wire of the respective pair so that loops of pile yarn are formed over only the second pile wire and thus form uncut pile loops in the fabric.

2. Apparatus according to claim 1 wherein said means for imparting relative longitudinal movement to each cooperating pair of pile wires includes pattern controlled means operatively connected to said second pile wires for selectively moving the same longitudinally relative to the respective first pile wires.

3. Apparatus according to claim 2 wherein the forward end of each second pile wire is foreshortened relative to the forward end of the cooperating first pile wire.

4. An apparatus according to claim 1 wherein said cooperating means on the pile wires of each cooperating pair includes a laterally offset portion on the second pile wire movable into sliding engagement with one side of a lengthwise portion of the respective first pile wire for diverting the same laterally away from the second pile wire with longitudinal movement of the cooperating pair of pile wires to said second position.

5. An apparatus according to claim 4 wherein said second pile wire is formed of a relatively thin, substantially rigid material and wherein at least said lengthwise portion of said first pile wire is formed of a more flexible material than the adjacent portion of said second pile wire.

6. In an apparatus having a reed and other means for forming pile fabrics having cut and uncut pile tufts and wherein pile wires extend through spaces defined by the reed dents and longitudinally of the fabric being formed and means are provided for positioning pile yarns laterally over and across the pile wires for forming pile loops thereon and for dipping the pile yarns into the fabric between the pile wires, the improvement wherein a plurality of the pile wires are arranged in side-by-side cooperating pairs of first and second pile wires with both pile wires of each cooperating pair extending through a common reed space, only each first pile wire having a cutting blade on a frontal portion thereof, each cooperating pair of pile wires being so arranged that, while they occupy a first position they are in close proximity where the pile loops extending over both wires, with such loops subsequently being cut by the cutting blade on the frontal portion of the respective first pile wire, means for imparting relative longitudinal movement to each cooperating pair of pile wires, and cooperating means on the pile wires of each cooperating pair and responsive to relative longitudinal movement of the pile wires to a second position for diverting the first pile wire laterally away from the second pile wire of the respective pair so that loops of pile yarn are formed over only the second pile wire and thus form uncut pile loops in the fabric.

7. In an apparatus for forming pile fabric having cut and uncut loop portions and wherein pile wires extend longitudinally of the fabric being formed and means are provided for positioning pile yarns laterally over and across the pile wires for forming pile loops thereon, the improvement comprising a plurality of pile wires arranged in side-by-side cooperating pairs of first and second pile wires, only said first pile wires having cutting blades on frontal portions thereof, each first pile wire having at least a lengthwise portion adjacent its cutting blade formed of a more flexible material than the adjacent portion of the cooperating second pile wire, said lengthwise portion also having a laterally offset portion extending therealong, each second pile wire having a laterally offset portion facing in a lateral direction common with that of the offset portion of the cooperating first pile wire, and means for imparting relative longitudinal movement to each cooperating pair of pile wires and wherein in one position, the pile wires have their respective offset portions in substantially lateral alignment for forming pile loops extending over both pile wires, with such loops subsequently being cut by the cutting blade on the frontal portion of the cooperating first pile wire, and wherein in another position, the respective offset portions of the pile wires are longitudinally offset, with the offset portion of the second pile wire bearing against said more flexible material of the first pile wire and flexing the same laterally away therefrom so that loops of pile yarn are formed over only the second pile loops in the fabric.

8. In an elongate pile wire for forming pile fabrics having a frontal portion with a cutting blade thereon, the improvement wherein a medial portion of the pile wire rearwardly of the cutting blade has a pile loop forming stage thereon provided with a laterally offset portion therein, and said offset portion being adapted to receive a laterally offset portion of a cooperating less flexible pile wire positioned alongside the same to prevent the offset portion of the cooperating pile wire from exerting a lateral camming effect thereon.

9. A pile wire according to claim 8 wherein said frontal portion of the pile wire includes a thickened portion thereon for receivingly supporting the cutting blade therein, and at least said medial portion of the pile wire being more flexible than said thickened portion so as to permit readily flexing laterally said medial portion of the pile wire.

10. An elongate pile wire for use in forming pile fabrics and being formed of a relatively thin but substantially rigid material, and said pile wire being characterized by having a frontal portion provided with a pile loop forming stage therein having a laterally offset portion therein, and said offset portion provided being adapted to engage and deflect laterally outwardly therefrom a cooperating but more flexible pile wire positioned alongside the same.

* * * * *

UNITED STATES PATENT AND TRADEMARK OFFICE

CERTIFICATE OF CORRECTION

PATENT NO. : 4,034,781

DATED : July 12, 1977

INVENTOR(S) : Paul Anthony Czelusniak, Jr.

It is certified that error appears in the above-identified patent and that said Letters Patent are hereby corrected as shown below:

Column 1, Line 8, "lopped" should be --looped--. Column 2, Line 65, after "13a" insert --arranged in staggered relation to spaced intervening reed dents 13b--; Line 66, "guite" should be --quite--. Column 3, Line 37, after "cooperating" insert --pairs--. Column 4, Line 1, "sequences" should be --sequence--. Column 6, Line 35, after "uncut" insert --pile--. Column 7, Line 47, CLAIM 6, after "pile" insert --yarns are positioned thereover for forming pile--. Column 8, Line 32, CLAIM 7, after "pile" insert --wire and thus form uncut pile--; Line 54, CLAIM 10, "therein" should be --thereon--; Line 55, delete "provided".

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*